US009776698B2

(12) United States Patent
Miyatake et al.

(10) Patent No.: US 9,776,698 B2
(45) Date of Patent: Oct. 3, 2017

(54) OUTBOARD MOTOR

(71) Applicant: YAMAHA HATSUDOKI KABUSHIKI KAISHA, Iwata-shi, Shizuoka (JP)

(72) Inventors: Yuta Miyatake, Shizuoka (JP); Ryota Numaguchi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 59 days.

(21) Appl. No.: 14/935,518

(22) Filed: Nov. 9, 2015

(65) Prior Publication Data

US 2016/0264226 A1 Sep. 15, 2016

(30) Foreign Application Priority Data

Mar. 10, 2015 (JP) ..... 2015-046696

(51) Int. Cl.

| | |
|---|---|
| ***B63H 20/00*** | (2006.01) |
| ***B63H 1/18*** | (2006.01) |
| ***B63H 20/32*** | (2006.01) |
| ***B63H 20/24*** | (2006.01) |
| ***B63H 20/36*** | (2006.01) |

(52) U.S. Cl.

CPC ..... *B63H 20/00* (2013.01); *B63H 1/18* (2013.01); *B63H 20/245* (2013.01); *B63H 20/32* (2013.01); *B63H 20/36* (2013.01)

(58) Field of Classification Search

CPC ..... B63H 20/00; B63H 1/18
USPC ..... 440/53
See application file for complete search history.

(56) References Cited

U.S. PATENT DOCUMENTS

| | | | | |
|---|---|---|---|---|
| 2,549,485 | A * | 4/1951 | Kiekhaefer | B63H 20/10 123/195 P |
| 2,676,559 | A * | 4/1954 | Davies | B63H 20/10 123/195 P |
| 6,024,616 | A * | 2/2000 | Takayanagi | F01P 3/202 123/198 E |
| 6,352,456 | B1 * | 3/2002 | Jaszewski | B63H 20/106 440/53 |
| 7,442,104 | B2 * | 10/2008 | Okabe | B63H 20/08 440/53 |
| 7,553,206 | B2 * | 6/2009 | Hasegawa | B63H 20/00 440/84 |

(Continued)

FOREIGN PATENT DOCUMENTS

EP 0 884 462 A2 12/1998

OTHER PUBLICATIONS

Official Communication issued in corresponding European Patent Application No. 15191144.3, dated Sep. 20, 2016.

*Primary Examiner* — Lars A Olson
*Assistant Examiner* — Jovon Hayes
(74) *Attorney, Agent, or Firm* — Keating and Bennett, LLP

(57) ABSTRACT

An outboard motor includes a drive shaft extending vertically from an engine and is rotated by the engine. An upper case covers the drive shaft. A propeller shaft extends perpendicularly or substantially perpendicularly to the drive shaft. A lower case covers the propeller shaft. A front handle is disposed forward of the drive shaft and below an engine cover. A rear handle is disposed rearward of the drive shaft and below the engine cover. The rear handle is disposed in a position lower than a position of the front handle.

13 Claims, 12 Drawing Sheets

(56) References Cited

U.S. PATENT DOCUMENTS

| | | | | |
|---|---|---|---|---|
| 7,662,005 | B2 * | 2/2010 | Provost | B63H 5/125<br>440/53 |
| 8,888,542 | B2 * | 11/2014 | Kinpara | B63H 20/00<br>440/1 |
| 2006/0003644 | A1 * | 1/2006 | Okabe | B63H 20/08<br>440/63 |
| 2007/0243777 | A1 * | 10/2007 | Hasegawa | B63H 20/00<br>440/84 |
| 2009/0017706 | A1 * | 1/2009 | Vignau | B63H 20/36<br>440/53 |
| 2013/0045648 | A1 * | 2/2013 | Kinpara | B63H 20/00<br>440/6 |
| 2016/0264226 | A1 * | 9/2016 | Miyatake | B63H 20/00 |

* cited by examiner

OUTBOARD MOTOR

BACKGROUND OF THE INVENTION

1. Field of the Invention

The present invention relates to an outboard motor.

2. Description of the Related Art

Outboard motors have been conventionally provided with a handle for portability. For example, an outboard motor disclosed in U.S. Pat. No. 6,352,456 is provided with a front handle and a rear handle, which are disposed at the same height.

When carrying an outboard motor, a person is required to tilt or highly lift the outboard motor so as not to cause the lower portion of the outboard motor to make contact with the ground. In the above-described outboard motor, however, the front handle and the rear handle are disposed at relatively high positions. Therefore, a person is required to carry the outboard motor with his/her elbows bent in order to tilt or highly lift the outboard motor. In such a posture, a large load acts on the arms of the person carrying the outboard motor, and hence, carrying the outboard motor is not easy.

SUMMARY OF THE INVENTION

Preferred embodiments of the present invention provide an outboard motor that is easy to carry.

An outboard motor according to a preferred embodiment of the present invention includes an engine, an engine cover, a drive shaft, an upper case, a propeller shaft, a lower case, a front handle, and a rear handle. The engine cover covers the engine. The drive shaft extends vertically from the engine and is rotated by the engine. The upper case covers the drive shaft. The propeller shaft extends perpendicularly or substantially perpendicularly to the drive shaft. The lower case covers the propeller shaft. The front handle is disposed forward of the drive shaft and below of the engine cover. The rear handle is disposed rearward of the drive shaft and below the engine cover. The rear handle is disposed in a position lower than a position of the front handle.

In the outboard motor according to the present preferred embodiment, the rear handle is disposed in the position lower than a position of the front handle. Therefore, compared to when the rear handle is disposed at a high position, a person can hold the outboard motor in a posture with his/her elbows extended while carrying the outboard motor, and this posture enables the person to easily use sufficient physical force while carrying the outboard motor. Accordingly, the person can easily carry the outboard motor.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
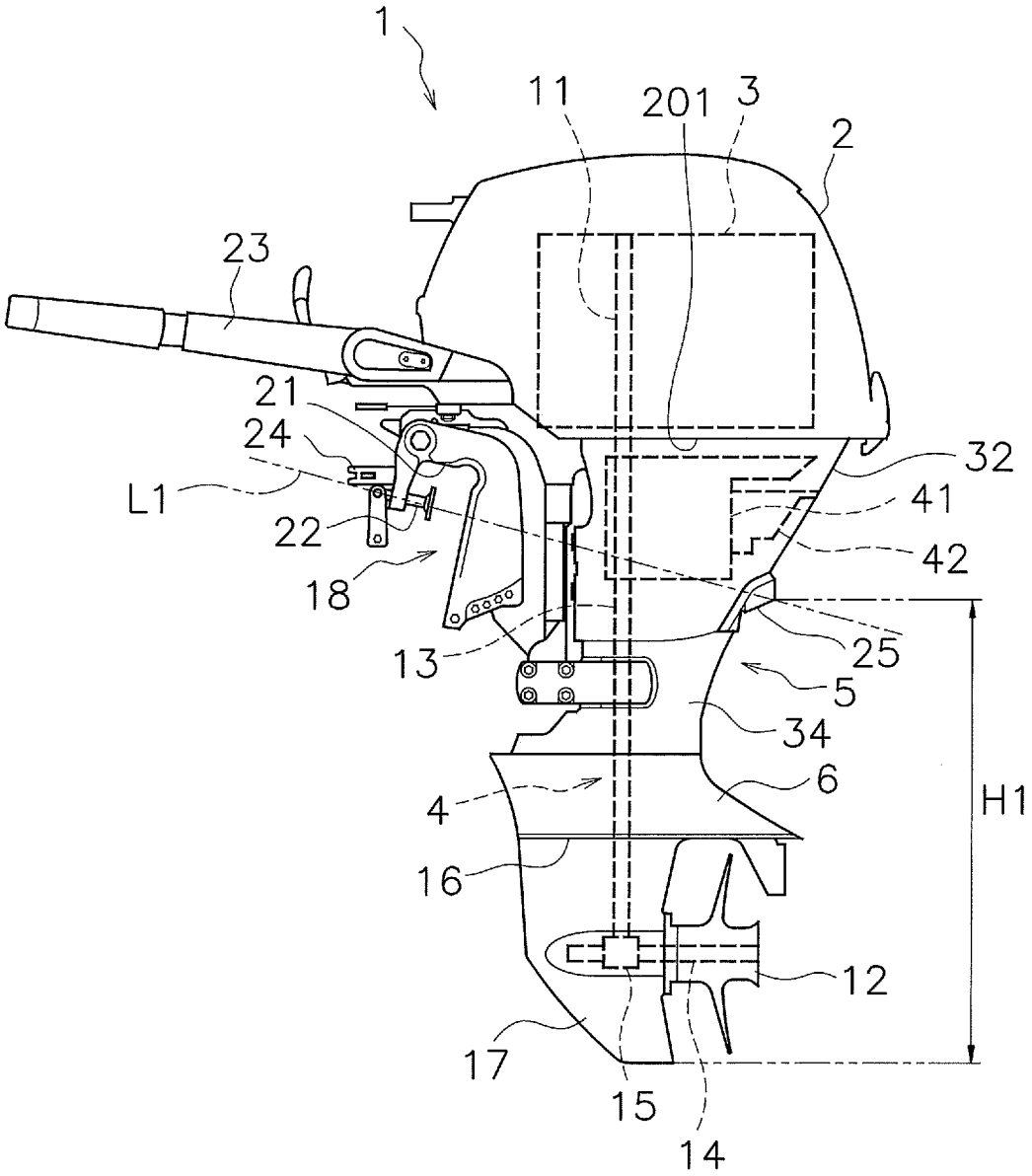
FIG. 1 is a side view of an outboard motor according to a preferred embodiment of the present invention.

Preferred embodiments of the present invention will be hereinafter explained with reference to the attached drawings. FIG. 1 is a side view of an outboard motor 1 according to a preferred embodiment of the present invention. The outboard motor 1 preferably includes an engine cover 2, an engine 3, a power transmission mechanism 4, an upper case 5, and a lower case 6. The engine cover 2 covers the engine 3. The engine 3 includes a crankshaft 11. The crankshaft 11 extends in an up-and-down direction.

The power transmission mechanism 4 transmits a driving force from the engine 3 to a propeller 12. The power transmission mechanism 4 includes a drive shaft 13, a propeller shaft 14, and a shift mechanism 15.

The drive shaft 13 extends in the up-and-down direction. The drive shaft 13 is coupled to the crankshaft 11, and is rotated by the engine 3. The propeller shaft 14 is coupled to the lower portion of the drive shaft 13 through the shift mechanism 15. The propeller shaft 14 extends in a back-and-forth direction. The propeller shaft 14 extends perpendicularly or substantially perpendicularly to the drive shaft 13.

The propeller 12 is attached to the rear end of the propeller shaft 14. The propeller shaft 14 transmits the driving force from the drive shaft 13 to the propeller 12. The propeller 12 is disposed in a lower portion of the outboard motor 1. The propeller 12 is driven and rotated by the driving force from the engine 3. The shift mechanism 15 switches the rotational direction of power transmitted from the drive shaft 13 to the propeller shaft 14.

The upper case 5 is disposed beneath the engine cover 2. The engine cover 2 and the upper case 5 are separate from each other. The upper case 5 covers the drive shaft 13.

The lower case 6 is disposed under the upper case 5. The lower case 6 covers the propeller shaft 14. The lower case 6 includes a cavitation plate 16. The cavitation plate 16 is a plate-shaped member protruding to the right and left from the lower case 6 (see FIG. 12). The cavitation plate 16 is disposed in a position higher than a position of the propeller shaft 14. The lower case 6 includes a skeg 17 at the bottom portion thereof. The skeg 17 is disposed in a position lower than the position of the propeller shaft 14. The back-and-forth directional dimension of the skeg 17 gradually decreases as the skeg 17 extends downward.

The outboard motor 1 includes a bracket 18. The bracket 18 is disposed forward of the upper case 5. The outboard motor 1 is attached to a vessel body through the bracket 18. The bracket 18 includes a recess 21 that is recessed upward. Clamps 22 are attached to the tip of the bracket 18. The edge of a vessel stern is disposed in the recess 21 and is clamped by the clamps 22 so as to be interposed and held between the bracket 18 and the clamps 22, such that the outboard motor 1 is attached to the vessel body.

The outboard motor 1 includes a tiller handle 23. The tiller handle 23 is disposed forward of the engine cover 2. The tiller handle 23 is disposed above the bracket 18.

The outboard motor 1 includes a front handle 24 and a rear handle 25. The front handle 24 is disposed forward of the drive shaft 13 and is disposed below the engine cover 2. The front handle 24 is attached to the bracket 18. The front handle 24 is disposed above the clamps 22. The front handle 24 is disposed in a position lower than a position of a lower edge 201 of the engine cover 2.

In a side view of the outboard motor 1, a straight line L1 connecting the front handle 24 and the rear handle 25 is inclined with respect to the axis of the drive shaft 13. The rear handle 25 is mounted in a vicinity of the vertical middle of the upper case 5. A height H1 of the rear handle 25 from the bottom of the outboard motor 1 is preferably about 700 mm or less, for example. Put differently, the height H1 of the rear handle 25 from the lower end of the skeg 17 is preferably about 700 mm or less, for example. The height H1 of the rear handle 25 from the bottom of the outboard motor 1 may alternatively be about 600 mm or less, for example.

Figure 2:
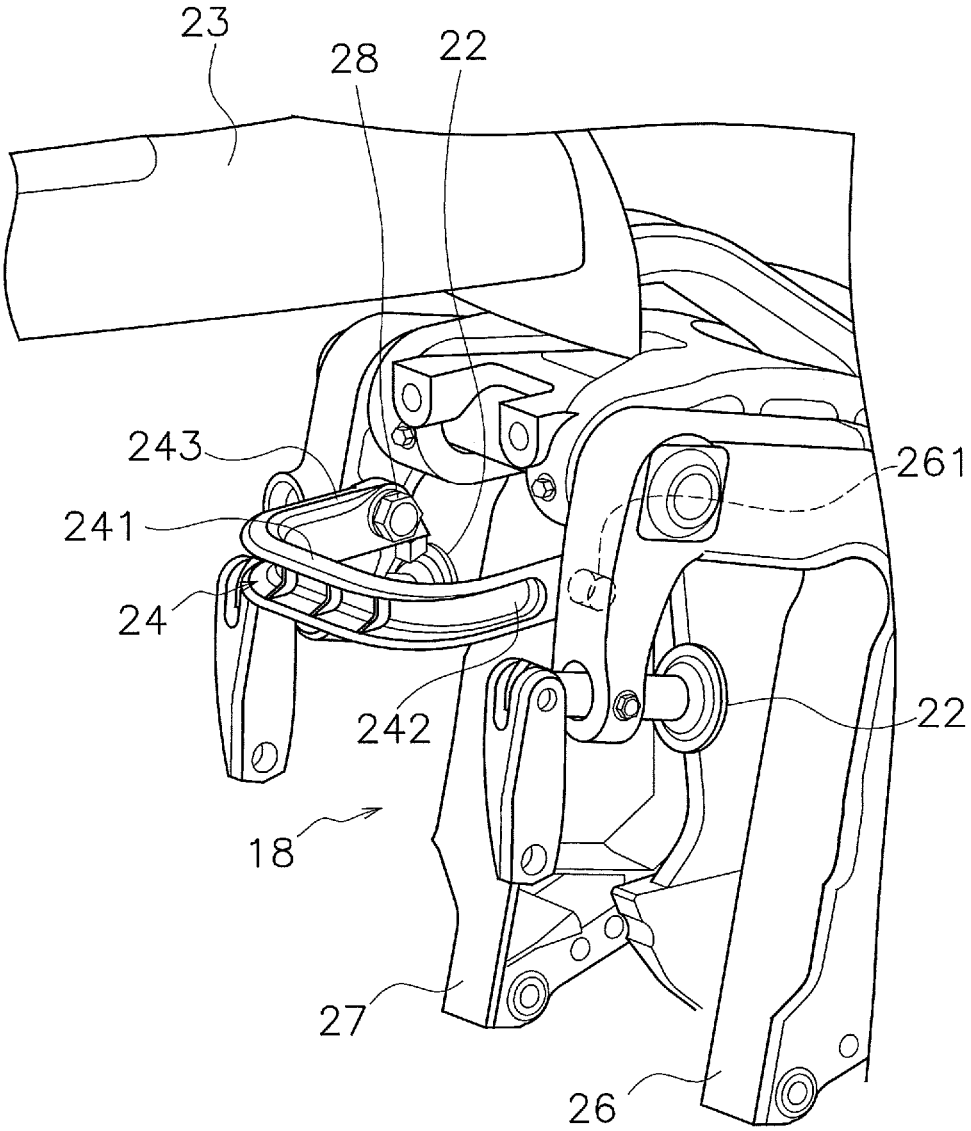
FIG. 2 is a perspective view of a structure of a bracket and its surroundings.
Figure 3:
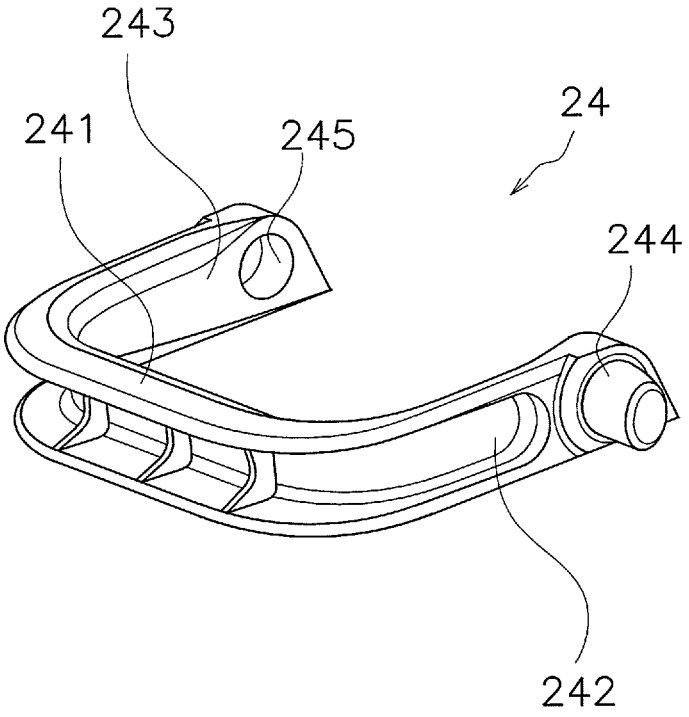
FIG. 3 is a perspective view of a front handle.

FIG. 2 is a perspective view of a structure of the bracket 18 and its surroundings. FIG. 3 is a perspective view of the front handle 24. As shown in FIG. 2, the bracket 18 includes a first bracket member 26 and a second bracket member 27. The first bracket member 26 and the second bracket member 27 are spaced apart in the right and left directions. The front handle 24 is disposed between the first bracket member 26 and the second bracket member 27.

As shown in FIG. 3, the front handle 24 is preferably U-shaped or substantially U-shaped. The front handle 24 includes a holding portion 241, a first connecting portion 242, and a second connecting portion 243. The first connecting portion 242 and the second connecting portion 243 are connected to the right and left ends of the holding portion 241. The first connecting portion 242 includes a boss 244 on the end thereof. The second connecting portion 243 includes a hole 245 in the end thereof. As shown in FIG. 2, the first bracket member 26 includes a circular recess 261 on the inner lateral surface thereof. The boss 244 is inserted into the recess 261. A bolt 28, for example, shown in FIG. 2 is inserted through the hole 245. The bolt 28 is fixed to the inner lateral surface of the second bracket member 27. With the above structure, the front handle 24 is fixed to the bracket 18.

As shown in FIG. 1, the rear handle 25 is disposed rearward of the drive shaft 13 and is disposed below the engine cover 2. The rear handle 25 is disposed in a position lower than a position of the front handle 24.

Figure 4:
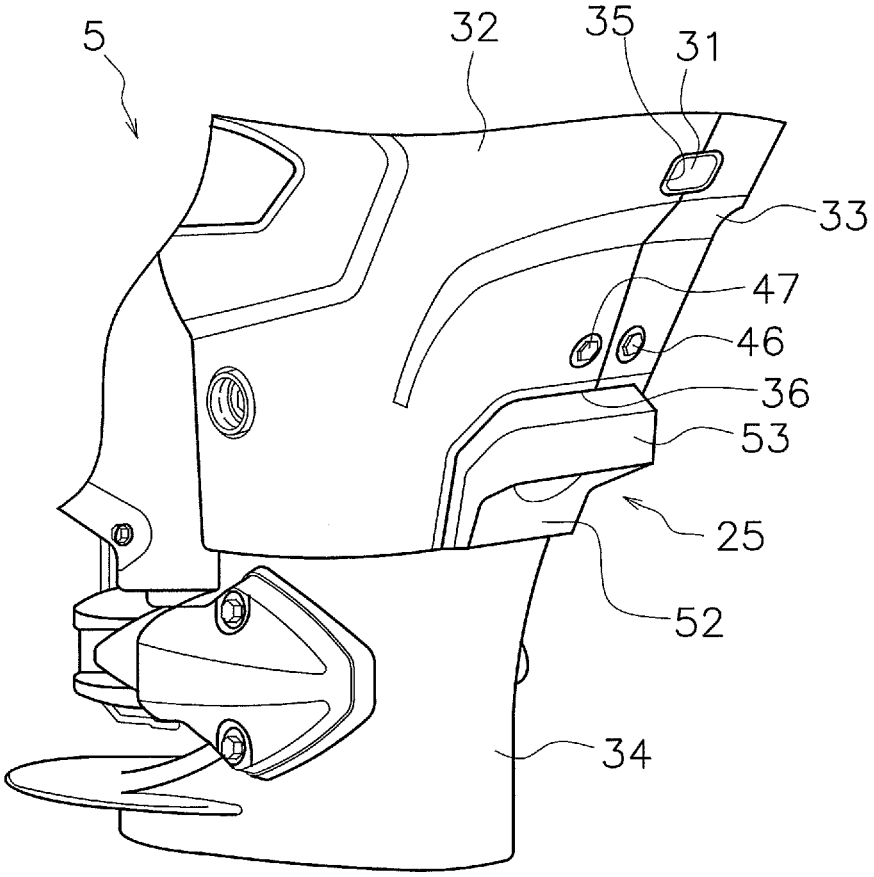
FIG. 4 is a perspective view of a structure of an upper case and its surroundings.

FIG. 4 is a perspective view of a structure of the upper case 5 and its surroundings. As shown in FIG. 4, the outboard motor 1 includes an idling exhaust port 31. Exhaust gas from the engine 3 during idling is discharged to the atmosphere through the idling exhaust port 31. The idling exhaust port 31 is open to the outside of the outboard motor 1 through the upper case 5. The rear handle 25 is disposed in a position lower than a position of the idling exhaust port 31.

As shown in FIG. 4, the upper case 5 includes a left apron 32, a right apron 33, and a lower portion 34. The left apron 32, the right apron 33, and the lower portion 34 are separate from each other. The left apron 32 and the right apron 33 are disposed above the lower portion 34. The idling exhaust port 31 is exposed to the outside of the outboard motor 1 through an opening 35 defined by the left apron 32 and the right apron 33.

A recess 36 is provided on the lower edge of the left apron 32 and the lower edge of the right apron 33 and is recessed upward. The rear handle 25 is disposed in the recess 36. The rear handle 25 is disposed between the lower portion 34 and the left and right aprons 32 and 33.

Figure 5:
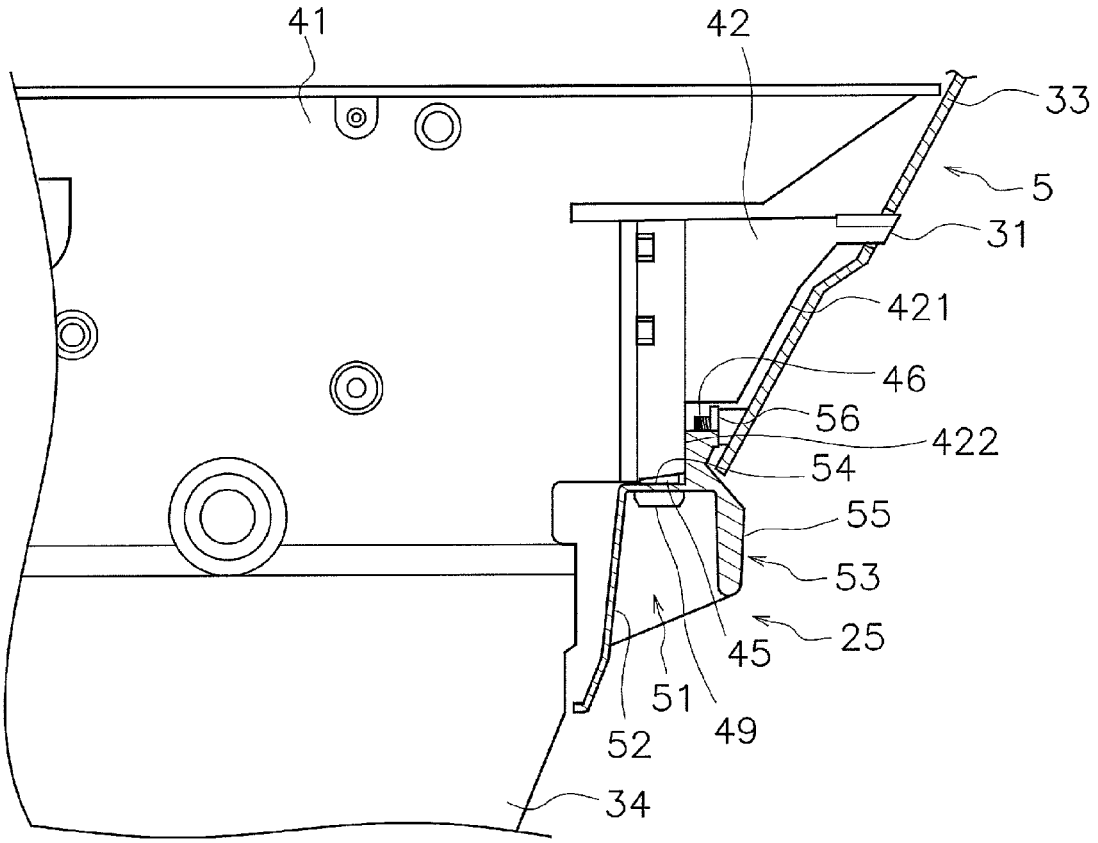
FIG. 5 is a cross-sectional view of an internal structure of the upper case.

FIG. 5 is a cross-sectional view of an internal structure of the upper case 5. As shown in FIG. 5, an oil pan 41 and a chamber 42 are disposed within the upper case 5. As shown in FIG. 1, the oil pan 41 is disposed below the engine 3. The chamber 42 and the oil pan 41 are disposed below the engine cover 2. The chamber 42 is disposed rearward of the oil pan 41. The chamber 42 is attached to the oil pan 41. The above-described idling exhaust port 31 is connected to the chamber 42 and protrudes rearwardly from the chamber 42. Exhaust gas from the engine 3 passes through the chamber 42.

The chamber 42 preferably has a stiffness higher than a stiffness of the rear handle 25. The chamber 42 preferably has a stiffness higher than a stiffness of the left and right aprons 32 and 33. For example, the chamber 42 is preferably made of metal such as an aluminum alloy. The rear handle 25 and the left and right aprons 32 and 33 are preferably made of a resin, for example. It should be noted that the material of the rear handle 25 is not limited to a resin and may be metal that has a stiffness lower than a stiffness of the chamber 42. The material of the left and right aprons 32 and 33 is not limited to a resin and may be metal that has a stiffness lower than a stiffness of the chamber 42.

Firm attachment of the rear handle 25 is enabled by attaching the rear handle 25 to the chamber 42 having a stiffness higher than a stiffness of the rear handle 25. Additionally, the temperature of the chamber 42 is lower than a temperature of the oil pan 41. Therefore, compared to when the rear handle 25 is attached to the oil pan 41, chances are low that attachment of the rear handle 25 is loosened due to thermal expansion.

Figure 6:
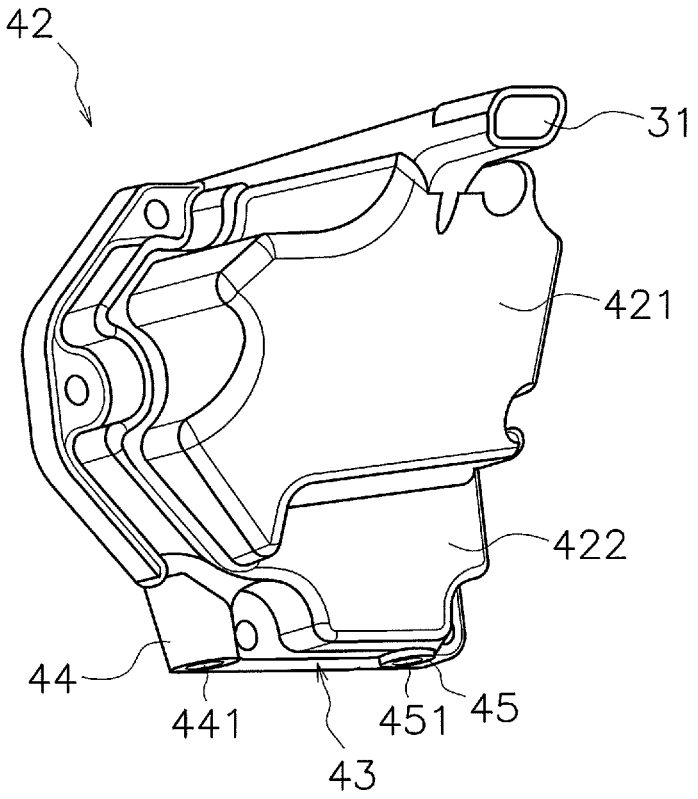
FIG. 6 is a perspective view of a chamber.

FIG. 6 is a perspective view of the chamber 42. As shown in FIG. 6, a support portion 43 is disposed at the bottom portion of the chamber 42. The rear handle 25 is attached to the support portion 43 of the chamber 42. The support portion 43 includes a first boss 44 and a second boss 45. The first boss 44 includes a bolt hole 441. The second boss 45 includes a bolt hole 451. The rear handle 25 is fixed to the support portion 43 by bolts, for example.

Figure 7:
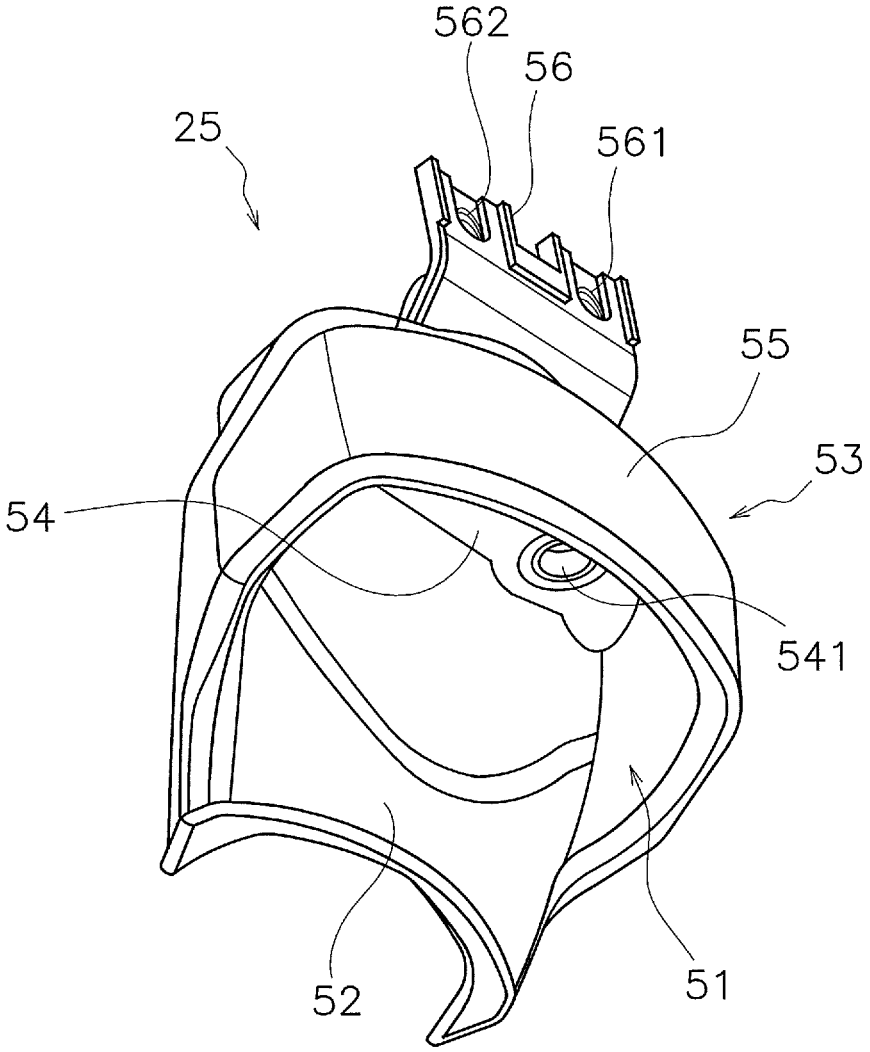
FIG. 7 is a perspective view of a rear handle.
Figure 8:
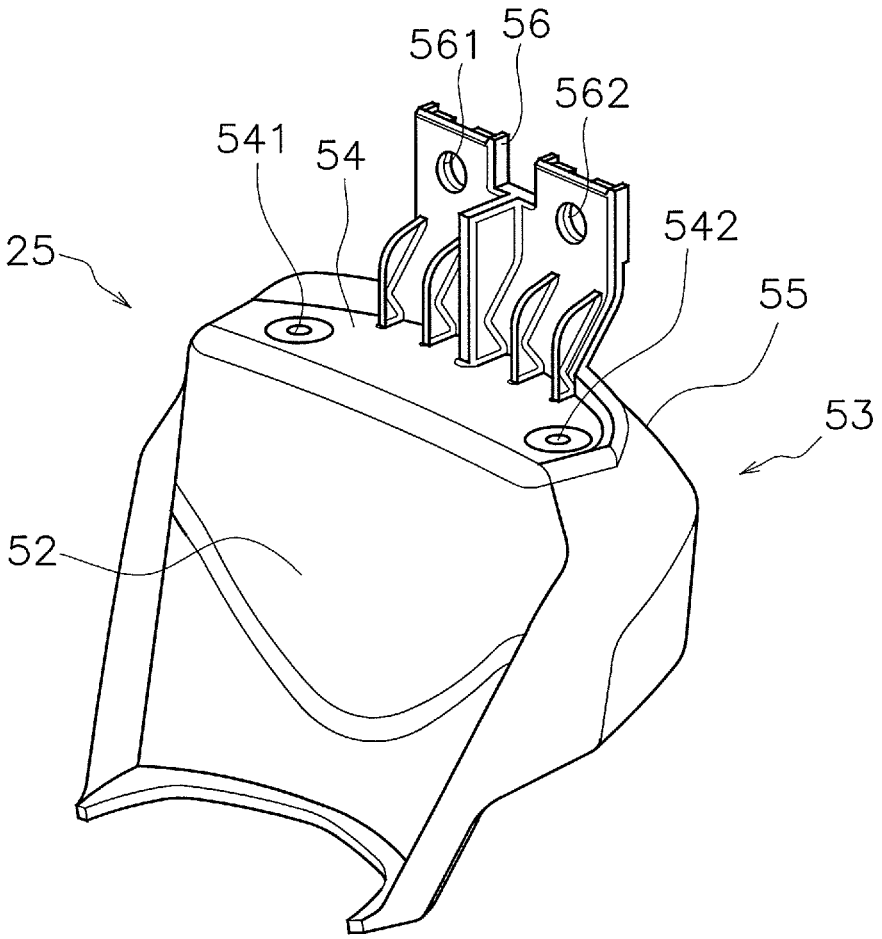
FIG. 8 is a perspective view of the rear handle.
Figure 9:
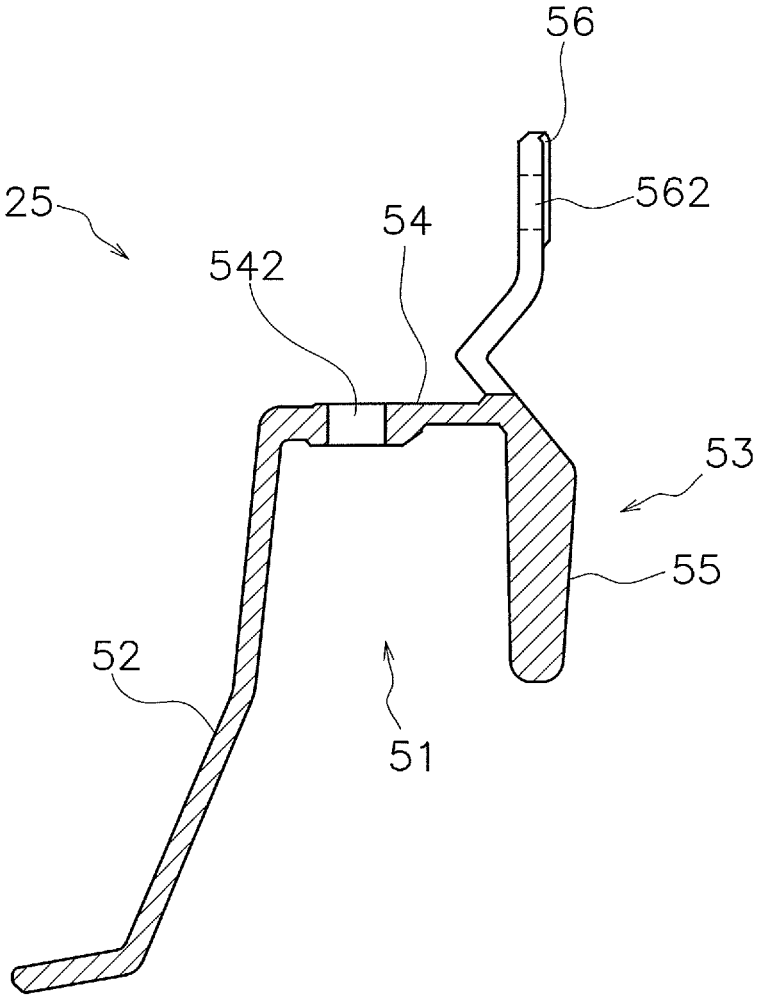
FIG. 9 is a cross-sectional view of the rear handle.

FIGS. 7 and 8 are perspective views of the rear handle 25. FIG. 9 is a cross-sectional view of the rear handle 25. As shown in FIG. 9, the rear handle 25 includes a recess 51 that is recessed upward. As shown in FIGS. 7 and 8, the rear handle 25 includes a wall portion 52 and a holding portion 53. The recess 51 is defined by the wall portion 52 and the holding portion 53. The wall portion 52 covers the internal space of the recess 51 from the front side. The wall portion 52 extends to a position lower than a position of the lower end of the holding portion 53. As shown in FIG. 5, the lower end of the wall portion 52 is disposed so as to overlap with the lower portion 34.

The holding portion 53 is disposed rearward of the wall portion 52. The holding portion 53 includes an upper surface 54 and a lateral surface 55. The upper surface 54 covers the internal space of the recess 51 from the upper side. The upper surface 54 is preferably shaped such that its right-and-left length is longer than its back-and-forth length. The lateral surface 55 covers the internal space of the recess 51 from the rear, right, and left sides. As shown in FIG. 8, the upper surface 54 includes holes 541 and 542. The holes 541 and 542 penetrate through the upper surface 54 in the up-and-down direction.

Figure 10:
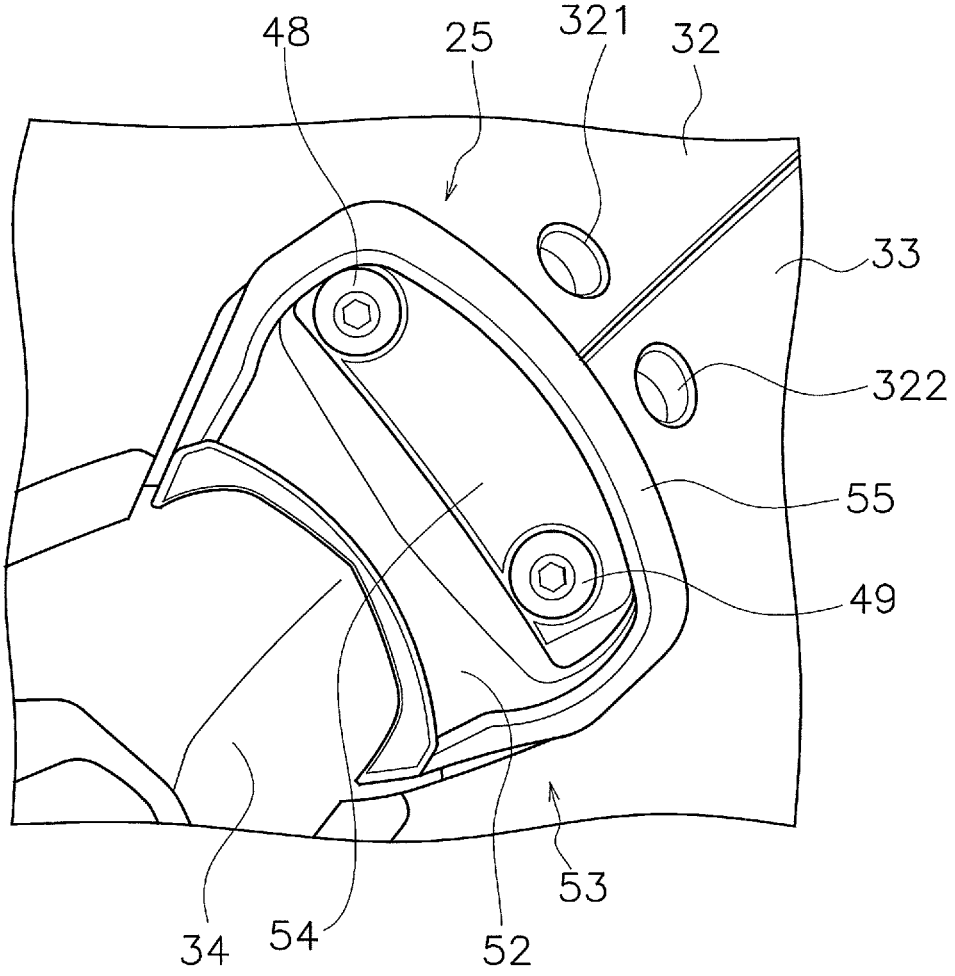
FIG. 10 is a view of the rear handle and its surroundings as seen from below.

As shown in FIG. 5, the upper surface 54 is disposed below the support portion 43 of the chamber 42. FIG. 10 is a view of a structure of the rear handle 25 and its surroundings as seen from below. As shown in FIGS. 5 and 10, the upper surface 54 is fixed to the support portion 43 by bolts 48 and 49, for example. The bolts 48 and 49 are inserted through the above-described holes 541 and 542 of the upper surface 54 and the above-described bolt holes 441 and 451 of the support portion 43.

The rear handle 25 includes an apron attaching portion 56. The apron attaching portion 56 protrudes upwardly from the holding portion 53. The apron attaching portion 56 is located rearward of the upper surface 54. The apron attaching portion 56 includes holes 561 and 562. The holes 561 and 562 penetrate through the apron attaching portion 56 in the back-and-forth direction.

As shown in FIG. 10, the left apron 32 includes a hole 321. The right apron 33 includes a hole 322. As shown in FIG. 4, the left and right aprons 32 and 33 are fixed to the apron attaching portion 56 by bolts 46 and 47, for example. The bolt 46 is inserted through the hole 322 of the right apron 33 and a hole 561 of the apron attached portion 56. The bolt 47 is inserted through the hole 321 of the left apron 32 and a hole 562 of the apron attaching portion 56.

As shown in FIG. 6, the chamber 42 includes a slope 421 and a step 422 on the rear surface thereof. The slope 421 is disposed beneath the idling exhaust port 31. As shown in FIG. 5, the slope 421 is disposed along the inner surfaces of the left and right aprons 32 and 33. The step 422 is disposed forward of the slope 421. The apron attached portion 56 of the rear handle 25 is disposed between the step 422 and the aprons 32 and 33.

It should be noted that, as shown in FIG. 1, the straight line L1 connecting the front handle 24 and the rear handle 25 is a line connecting the lower end of the holding portion 241 of the front handle 24 and the lower end of the holding portion 53 of the rear handle 25. It should be noted that the straight line L1 connecting the front handle 24 and the rear handle 25 may be a line connecting the position to which the front handle 24 is attached to the outboard motor 1 and the position to which the rear handle 25 is attached to the outboard motor 1. Alternatively, the straight line L1 connecting the front handle 24 and the rear handle 25 may be a line connecting another portion of the front handle 24 and another portion of the rear handle 25.

The height H1 of the rear handle 25 from the bottom of the outboard motor 1 is a height from the bottom of the outboard motor 1 to the lower end of the holding portion 53 of the rear handle 25. It should be noted that the height H1 of the rear handle 25 from the bottom of the outboard motor 1 may be a height from the bottom of the outboard motor 1 to the position to which the rear handle 25 is attached to the outboard motor 1. Alternatively, the height H1 of the rear handle 25 from the bottom of the outboard motor 1 may be a height from the bottom of the outboard motor 1 to another portion of the rear handle 25.

In the outboard motor 1 according to the present preferred embodiment as explained above, the rear handle 25 is disposed in a position lower than a position of the front handle 24. Therefore, compared to when the rear handle 25 is disposed in a high position, a person can hold the outboard motor 1 in a posture with his/her elbows extended while carrying the outboard motor 1, and the posture enables the person to use sufficient physical force while carrying the outboard motor. Therefore, the person can easily carry the outboard motor.

Additionally, when detached in a tilt-up position from the vessel body, the outboard motor 1 can be lifted up while gripping the rear handle 25. Therefore, the outboard motor 1 can be easily detached from the vessel body.

Preferred embodiments of the present invention have been explained above. However, the present invention is not limited to the above-described preferred embodiments, and a variety of changes can be made without departing from the scope of the present invention.

Figure 11:
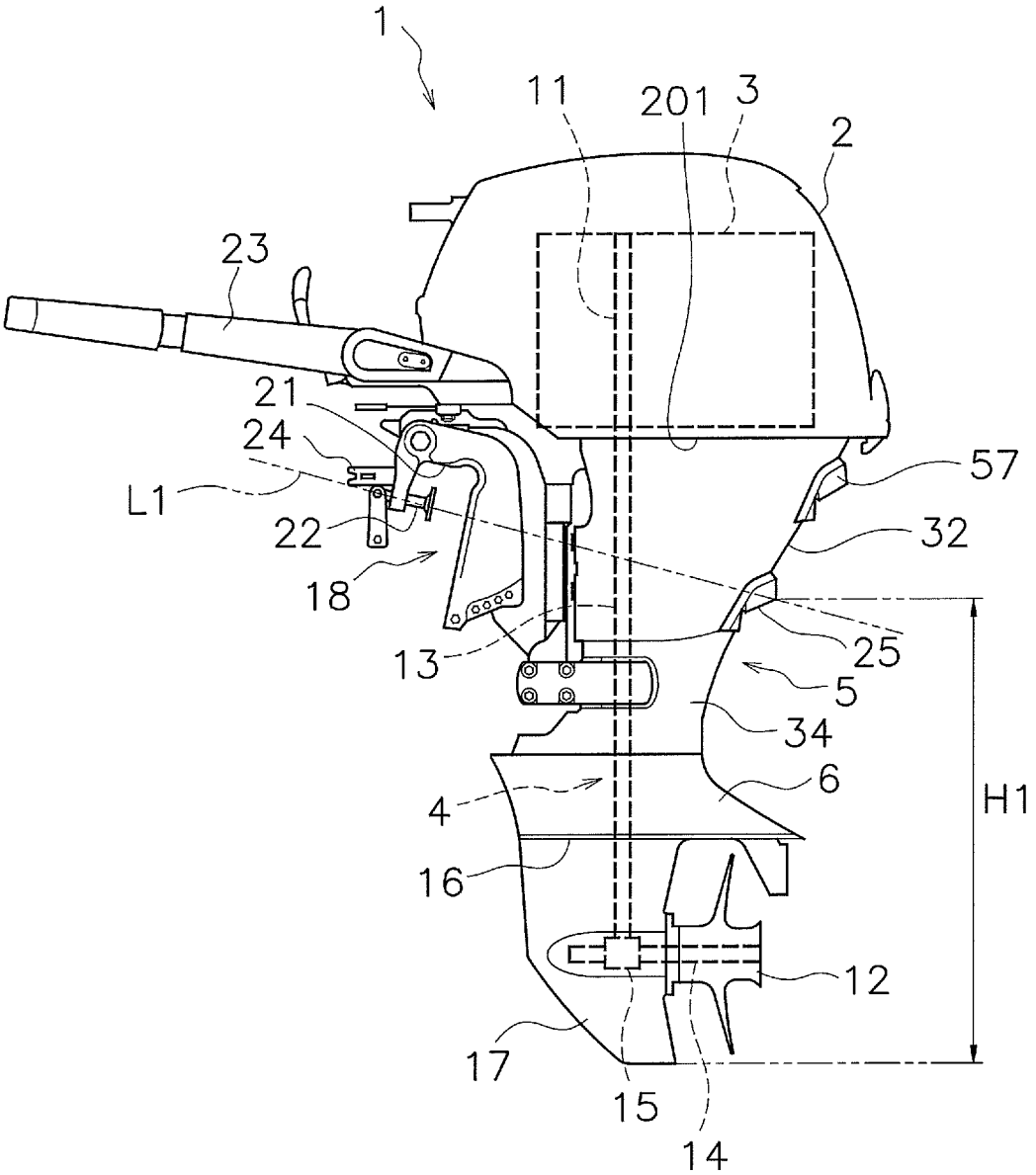
FIG. 11 is a side view of an outboard motor according to a first modified preferred embodiment of the present invention.

The outboard motor 1 may further include a second rear handle 57 disposed in a position different from a position of the rear handle 25 according to the above-described preferred embodiments. In this case, a carrier can carry the outboard motor 1 in a more flexible posture. FIG. 11 is a side view of the outboard motor 1 according to a first modified preferred embodiment of the present invention. As shown in FIG. 11, the second rear handle 57 may be disposed in a position higher than a position of the rear handle 25. The second rear handle 57 may be disposed at the same height as the front handle 24.

The position and the structure of the front handle 24 are not limited to those of the above-described preferred embodiments, and may be changed. The position and the structure of the rear handle 25 are not limited to those of the above-described preferred embodiments, and may be changed.

Figure 12:
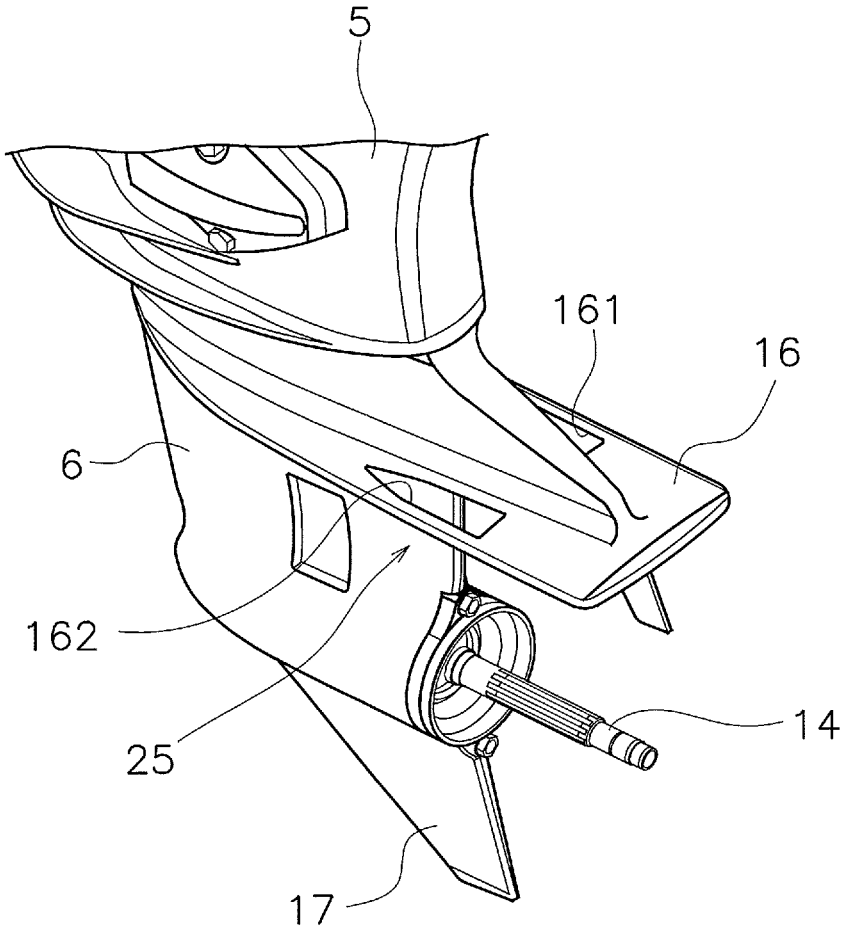
FIG. 12 is a side view of an outboard motor according to a second modified preferred embodiment of the present invention.

For example, the rear handle 25 may be provided on the lower case 6. FIG. 12 is a partial perspective view of the outboard motor 1 according to a second modified preferred embodiment of the present invention. As shown in FIG. 12, the rear handle 25 may be provided on the cavitation plate 16 of the lower case 6. The rear handle 25 is defined by through holes 161 and 162 provided in the cavitation plate 16. In this case, as shown in FIG. 12, a pair of right and left through holes 161 and 162, for example, are provided in the cavitation plate 16. Moreover, together with the rear handle 25 of the above-described preferred embodiments, the through holes 161 and 162 may define a second rear handle in the cavitation plate 16.

In the above-described preferred embodiments, the idling exhaust port 31 is open to the outside of the outboard motor 1 through the upper case 5. However, the position of the idling exhaust port 31 is not limited to the upper case 5, and may be changed. For example, the idling exhaust port 31 may be open to the outside of the outboard motor 1 through the engine cover 2.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

an engine cover covering the engine;

a drive shaft extending vertically from the engine and rotated by the engine;

an upper case covering the drive shaft;

a propeller shaft extending perpendicularly or substantially perpendicularly to the drive shaft;

a lower case covering the propeller shaft;

a front handle disposed forward of the drive shaft and under the engine cover; and a rear handle disposed rearward of the drive shaft and under the engine cover, the rear handle being disposed in a position lower than a position of the front handle.

2. The outboard motor according to claim 1, wherein in a side view of the outboard motor, a straight line connecting the front handle and the rear handle is inclined with respect to an axis of the drive shaft.

3. The outboard motor according to claim 1, further comprising:

an idling exhaust port that discharges an exhaust gas from the engine to an outside of the outboard motor during idling; wherein the position of the rear handle is lower than a position of the idling exhaust port.

4. The outboard motor according to claim 1, wherein the rear handle is provided in a vicinity of a middle of the upper case in a vertical direction.

5. The outboard motor according to claim 1, wherein the rear handle is provided on the lower case.

6. The outboard motor according to claim 5, wherein the lower case includes a cavitation plate, and the rear handle is provided on the cavitation plate.

7. The outboard motor according to claim 3, wherein the idling exhaust port is open to atmosphere through either the engine cover or the upper case.

8. The outboard motor according to claim 1, wherein a height of the rear handle from a bottom of the outboard motor is about 700 mm or less.

9. The outboard motor according to claim 1, further comprising a second rear handle disposed in a position different in height from the position of the rear handle.

10. The outboard motor according to claim 9, wherein the position of the second rear handle is higher than the position of the rear handle.

11. The outboard motor according to claim 1, wherein the lower case includes a skeg at a bottom portion thereof.

12. The outboard motor according to claim 1, further comprising a propeller attached to a rear end of the propeller shaft.

13. The outboard motor according to claim 1, wherein the engine cover and the upper case are separate from each other.

* * * * *